United States Patent [19]

Gelfand et al.

[11] 4,008,057

[45] Feb. 15, 1977

[54] ELECTROSTATIC PRECIPITATOR ELECTRODE CLEANING SYSTEM

[75] Inventors: Peter C. Gelfand; Richard A. Carpenter, both of Lebanon; Jerry F. Shoup, Palmyra, all of Pa.

[73] Assignee: Envirotech Corporation, Menlo Park, Calif.

[22] Filed: Nov. 25, 1974

[21] Appl. No.: 526,990

[52] U.S. Cl. ..... 55/105; 55/112; 55/139

[51] Int. Cl.[2] ..... B03C 3/66

[58] Field of Search ..... 55/112, 111, 139, 105, 55/273

[56] References Cited

UNITED STATES PATENTS

| | | | |
|---|---|---|---|
| 3,469,371 | 9/1969 | Gelfand | 55/112 |
| 3,483,669 | 12/1969 | Glaeser et al. | 55/112 |
| 3,487,606 | 1/1970 | Bridges et al. | 55/112 |
| 3,504,480 | 4/1970 | Copcutt et al. | 55/139 |
| 3,754,379 | 8/1973 | Bridges et al. | 55/112 |

*Primary Examiner*—Bernard Nozick
*Attorney, Agent, or Firm*—Robert E. Krebs; Thomas S. MacDonald

[57] ABSTRACT

Electrically-activated shaking devices are arranged in modules to shake the electrodes of an electrostatic precipitator, each module corresponding to a different section of the precipitator. An operating system for the shaking devices includes a main distributor circuit that sends electrical signals to individual control circuits at each of the modules in sequence and at a relatively fast rate. Each control circuit has an adjustable timer that independently generates pulses at a relatively slow rate and a synchronizing circuit that generates an output signal only if it receives a signal from the timer followed by a signal from the main distributor. Each control circuit further includes a secondary distributor circuit that operates in response to the synchronizing circuit to activate the shaking devices in the associated module sequentially. An inhibit device operated by the synchronizing circuit prevents more than a single shaker from being activated at a time.

12 Claims, 8 Drawing Figures

ELECTROSTATIC PRECIPITATOR ELECTRODE CLEANING SYSTEM

BACKGROUND OF THE INVENTION

1. Field of the Invention

The present invention relates to a system for cleaning the collecting plates and/or emitting wires in an electrostatic precipitator and, more particularly, to a control system that regulates the operation of rapping or vibrating devices for effectuating such cleaning.

2. State of the Art

Electrostatic precipitators are widely used for removing contaminating particles and droplets from gaseous streams. The typical electrostatic precipitator in large-scale applications includes a housing in which banks of vertically-extending collector electrode plates are disposed such that a dust-laden gaseous stream can pass at relatively high velocity through the housing parallel to the surfaces of the plates. Electrically, the collector plates are connected to ground. Active or emitting electrode wires hang vertically between the banks of collector plates and are electrically charged to as much as minus 45 to 50 thousand volts. In operation, an electric corona discharge from the emitting wires ionizes the neighboring gas molecules which then adhere to the dust particles and carry the same to the collector plates under the influence of electrostatic force.

In conventional practice, the collecting plates are periodically impacted or rapped so that the collected particulates fall by gravity to the floor of the housing for subsequent removal. It is also known to vibrate the emitter wires periodically to discharge any particles therefrom. A recognized problem in this art is to perform the rapping and vibrating functions in an optimal manner. When rapping or vibrating is conducted in a sub-optimal fashion, dislodged particulates are re-entrained in the gaseous stream flowing out of the precipitator. Sometimes puffs of particulates can actually be observed to issue from the precipitator outlet, thereby indicating that the precipitator is operating inefficiently.

SUMMARY AND OBJECTS OF THE INVENTION

The primary object of the present invention is to provide improved ways and means for automatically controlling the cleaning of the electrodes in an electrostatic precipitator.

A more specific object is to provide improved ways and means for regulating the operation of a large number of impacting or vibrating devices for effectuating the cleaning of the collecting plates and/or emitting wires in an electrostatic precipitator.

Yet another object is to provide an operating system for a larger number of electrode-striking devices on an electrostatic precipitator which operating system activates the devices at various frequencies and intensities according to the location of the electrodes in the precipitator.

The present invention recognizes that there can be differences in particle deposition rates on the electrodes and in the quality of the deposits depending upon the location of the electrodes within a single large precipitator and, in view of that, provides a system for individually controlling electrode-striking devices in accordance with the electrode locations. The present invention allows each section of a large precipitator to be treated.

BRIEF DESCRIPTION OF THE DRAWINGS

These and other objects and advantages of the present invention may be readily ascertained by reference to the following description and appended drawings which are offered by way of example only and not in limitation of the invention, the scope of which is defined by the appended claims and equivalents to the structure, materials and acts recited hereinafter.

In the drawings.

DETAILED DESCRIPTION OF THE PREFERRED EMBODIMENT

Figure 1:
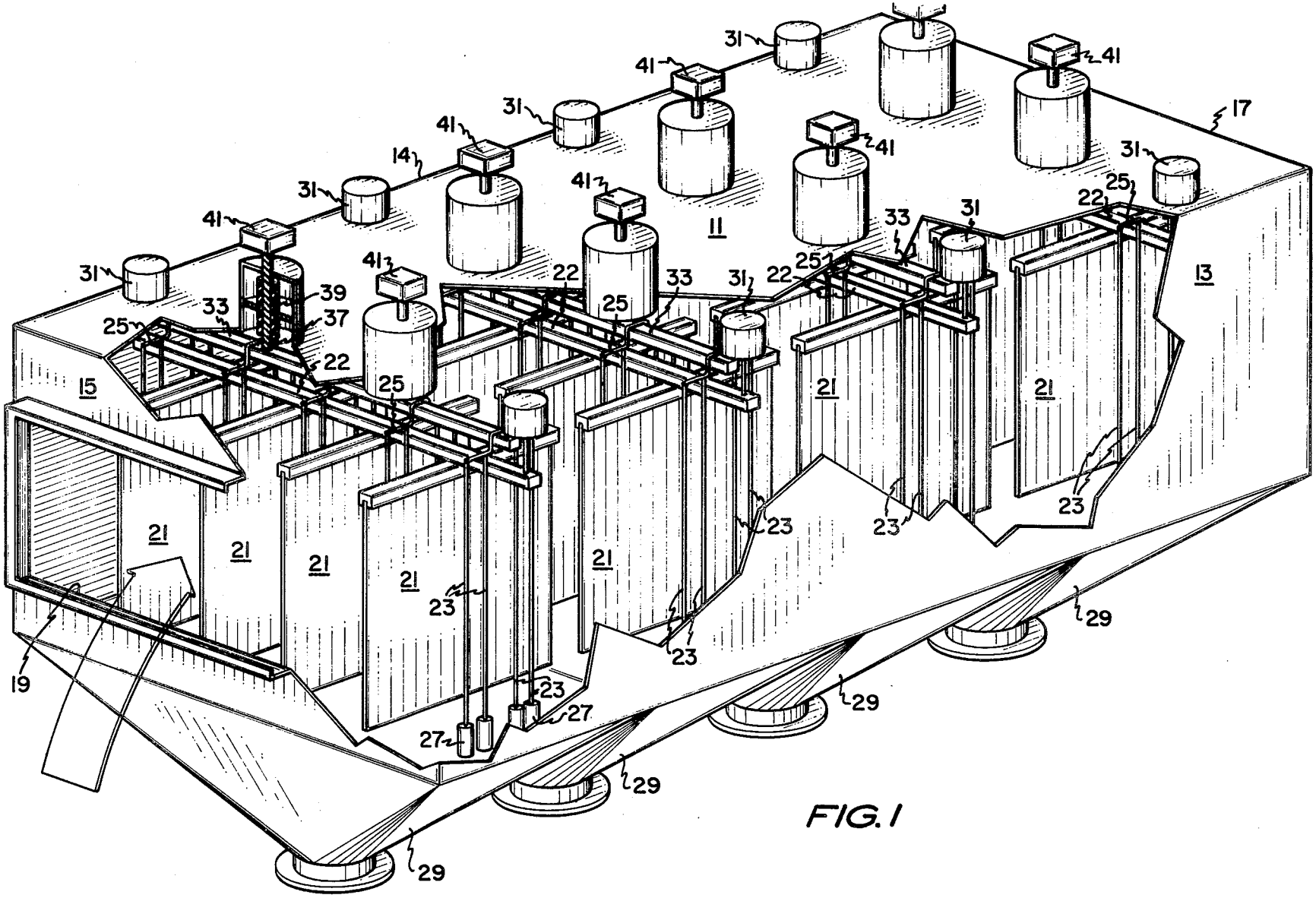
FIG. 1 is a pictorial view, partially cut away, illustrative of the type of electrostatic precipitator on which the system of the invention is used.

As shown in FIG. 1, a typical electrostatic precipitator includes a main housing or shell having a roof 11, sidewalls 13 and 14, and front and back endwalls 15 and 17, respectively. Particulate-laden gases pass at relatively high velocity into the precipitator through a large inlet opening 19 in the front wall 15 and cleaned gases exit through an opening, not shown, in the rear wall 17. Banks of vertically-disposed collector plates 21 are stationarily supported from above by structural beams 22 to define a number of parallel straight flow paths within the housing between the inlet and the outlet. The beams 22 are rigidly supported from the housing's structural frame, not shown. Emitting wires 23 hang between the collector plates and are suspended in sets from electrically-conductive hanger members 25. Heavy tensioning weights 27 are attached to the lower ends of the emitter wires 23 so that they hang straight and do not touch the collector plates 21. As previously mentioned, the collector plates are electrically grounded and, hence, are at zero voltage potential whereas the emitter wires are highly charged.

In the operation of the precipitator, the high voltage on the emitter wires 23 results in the establishment of an electric field and a corona discharge directed toward the collector plates 21. The corona and electrostatic field ionizes gas molecules which subsequently adhere to the particulate matter and are attracted to the grounded collector plates by electrostatic or Coulomb force. Periodically, the collector plates must be impacted or rapped to dislodge the accumulated particulates, which then fall by gravity into hoppers 29 disposed in the base of the housing 11 for subsequent removal.

The collector plates 21 are impacted by solenoid-type rappers or impactors 31 which are mounted on the roof 11 of the housing and connected at spaced-apart locations to associated ones of the structural beams 22 which fixedly support the collector plates. More specifically, the solenoid coils of the rappers are stationarily mounted on the roof 11 and the cores are free to move under the influence of magnetic fields established by electric current passing through the coils to strike the beams 22.

The aforementioned hangers 25 that support the emitter wires 23 are fixed at intervals to electrically-conductive rigid beams 33 which extend transversely across the precipitator housing below the roof 11. In turn, the beams 33 are individually suspended by electrically-conductive rods 37 which hang downward at spaced-apart locations through specially-designed cylindrical insulators 39 fixedly mounted on the roof 11. The upper ends of the rods 37 are connected to a high voltage source, not shown, which typically comprises a large transformer and rectifier set mounted on the roof of the housing. To shake or vibrate the emitter wires for cleaning, conventional vibrating units 41 are mounted to strike the upper ends of the support rods 37 to selectively shake the associated beams 33 and hence to vibrate the emitter wires 23 to dislodge accumulated particles therefrom.

In practice, many more rappers and vibrators are used on a precipitator than are shown in FIG. 1. Many times, several hundred impacting devices are used on a single precipitator.

In the following, an operating system will be described for regulating the operation of a large number of solenoid rappers for effectuating cleaning of the collector plates of an electrostatic precipitator. It should be appreciated that basically the same system can be utilized for controlling the operation of the vibrators for cleaning the emitter wires. Generally speaking, each operating system serves (1) to control the sequencing rate or time interval between impacts delivered by the solenoid rappers in an associated "module", (2) to determine the intensity of each impact, and (3) to insure that only a single rapper is operating at any given time. Those functions are coordinated by timing pulses generated by a common clock circuit.

Figure 2:
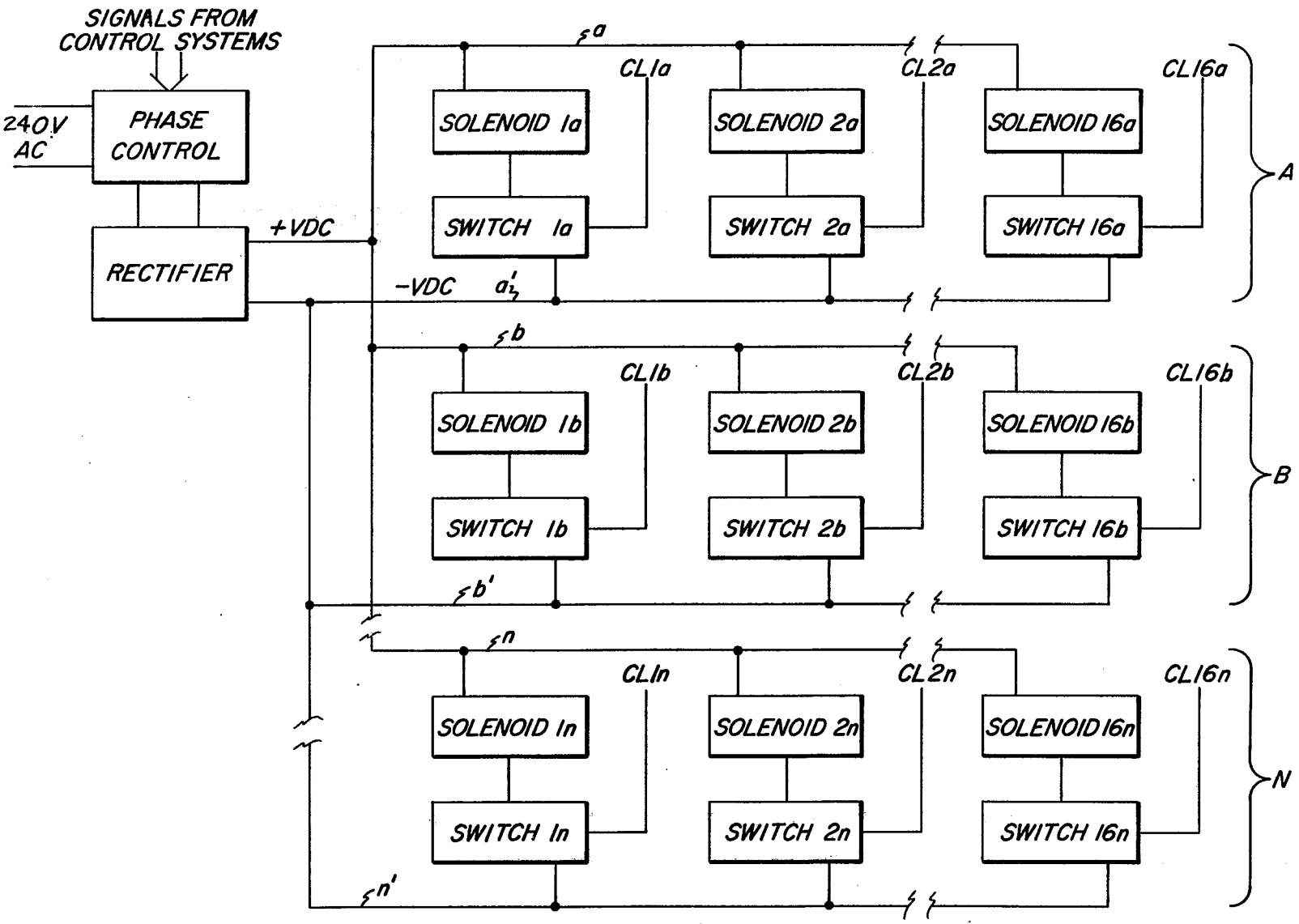
FIG. 2 is a schematic block diagram of an array comprising rows or modules of impacting devices.

FIG. 2 shows several modules A, B, and N of the solenoid rappers. Typically, sixteen modules containing sixteen rappers each are provided. The following description will assume the full complement of modules and rappers but the system can utilize fewer or more modules or rappers, the principal of operation being the same. In FIG. 2, each module comprises a row of sixteen solenoid rappers (i.e., 1*b*, 2*b*, . . . 16*b*) that extends across the precipitator in a direction perpendicular to the gas flow to operate upon a single bank of collector plates or section of the precipitator. One advantage of arranging the rappers in rows is that the particulates which become entrained in the gas stream during the rapping of an upstream bank of collector plates are thereafter collected on subsequent plates downstream.

According to FIG. 2, 240 volt 60Hz AC line power is supplied to a conventional phase-control circuit which determines the conduction angle and duration of the power supplied to a conventional full-wave bridge rectifier. The direct current output from the rectifier is carried by pairs of parallel busses *a-a'*, *b-b'*, etc., to the corresponding rapper modules. Within the modules, each solenoid rapper is connected in series with an associated electronic on-off switch or relay between the associated buss pair. Thus, for example, the first solenoid rapper 1*b* in the second module is in series with switch 1*b* across the busses *b-b'*. The switch positions are determined by signals carried by respective control lines CL1*a*–CL16*n*. When one of the switches is closed, current is able to flow through the switch from one buss to the other to energize the associated solenoid. When energized, the core of the solenoid will rise within its coil to a height proportional to the energy supplied during the power intervals and then the core drops and strikes the collector support structure causing an impact to be transmitted to the associated collector plate to shear dust and other collected particles therefrom.

The positions of all of the switches in any one module are determined by an associated control system which opens and closes each of the switches sequentially at predetermined intervals. A separate control system is provided for each module; thus, a first control system sequentially activates control lines CL1*a*–CL16*a*, a second system sequentially activates control lines CL1*b*–CL16*b* and so forth. The phase or conduction angle of the line power to the rectifier is also determined by signals from the individual control systems. The conduction angle determines the energy carried by the power busses and, thereby, determines the intensity of the rapper action.

Figure 3:
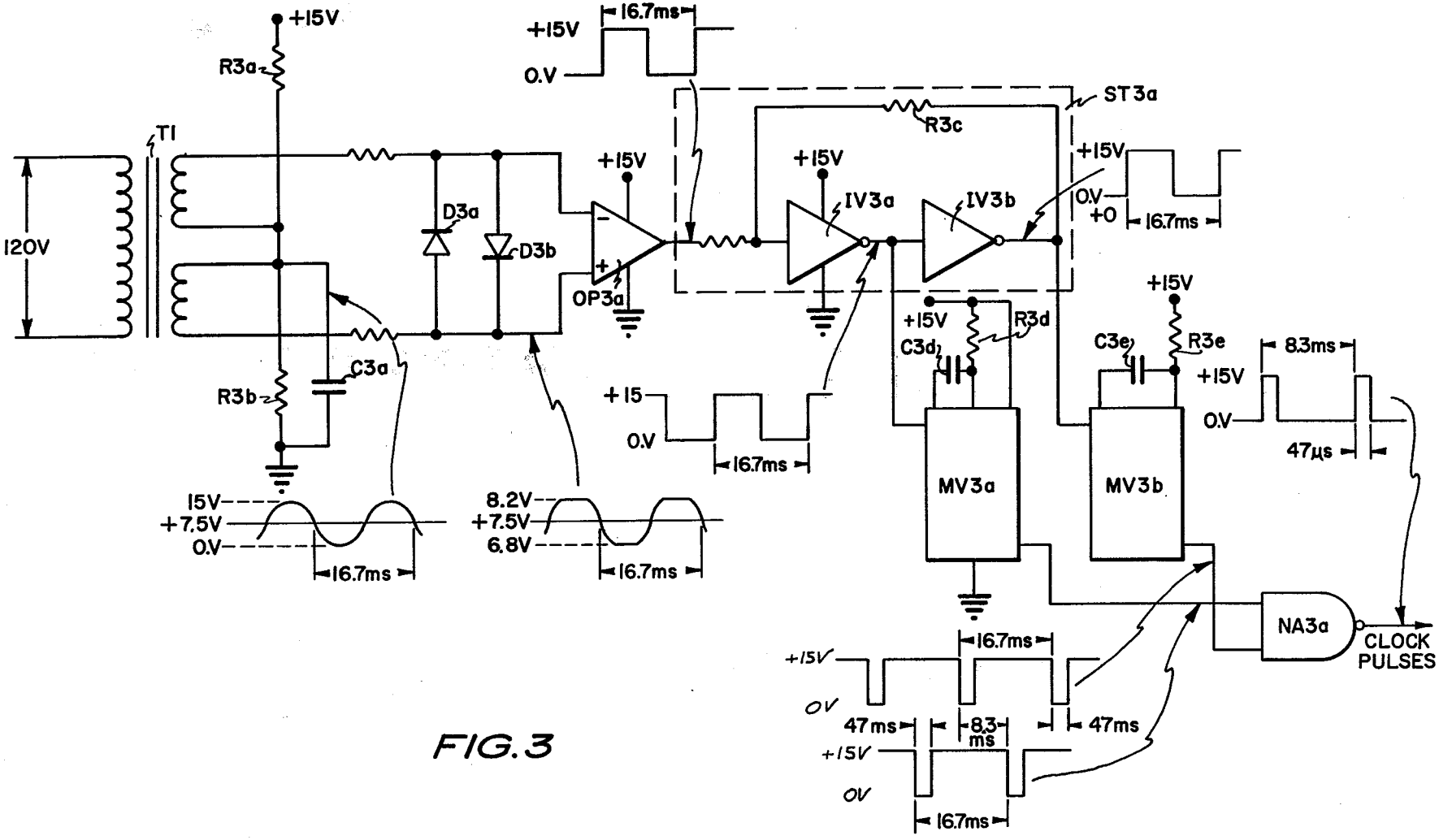
FIG. 3 is a schematic diagram of a clock circuit for the system of the invention.

The aforementioned clock circuit is shown in detail in FIG. 3 and signal waveforms at various points within the circuit are superimposed on the drawing. It should be understood, however, that the illustrated circuit is exemplary only and that various other well-known pulse train generating circuits can provide the same functions.

According to FIG. 3, power (normally 120 volt 60 cycle AC) is carried to a conventional step-down transformer T1. The sinusoidal voltage across the secondary winding of the transformer is reduced in magnitude according to the number of windings but has the same frequency or period (about 16.7 miliseconds) as the line power. The transformer is center-tapped and includes resistors R3*a* and R3*b* which comprise a voltage divider that biases the output voltage to about 7.5 volts, positive. Diodes D3*a* and D3*b* are connected back-to-back across the secondary winding output lines and serve to clip the peaks and valleys of the stepped-down voltage waveform. Although not strictly necessary, such clipping avoids the transmission of inordinately high voltages to subsequent components. The clipped signals are fed to the respective input terminals of a conventional high-gain operational amplifier OP3*a* which functions to convert the input signal to an essentially square wave output. When the operational amplifier is connected as illustrated, its output saturates at +15 volts and at zero volts, respectively, in response to input signals which vary even by a fraction of a volt either way from the 7.5 volt reference. Since the input signal level alternates above and below the reference, the amplifier OP3*a* serves to generate a train of square waves or pulses where the leading and trailing edges of the pulses occur at each zero crossing of the supply voltage.

Where subsequent circuitry uses especially fast solid-state logic components, such as MHTL (Motorola High Threshold logic), the rise-and-fall or slew rates of the output from the operational amplifier OP3*a* may be relatively too slow. To increase the slew rates, a conventional Schmitt trigger circuit ST3*a* can be used. The illustrated Schmitt trigger comprises a combination of two active pull-up inverting amplifiers IV3*a* and IV3*b* connected in series with feed back through resistor R3*c*. In the illustrated Schmitt trigger circuit, the inverted and non-inverted output pulses from the respective inverters IV3*a* and IV3*b* are fed separately to respective conventional monostable multivibrators MV3*a* and MV3*b* which are triggered on the rising edges of the pulses. The monostable multivibrators serve to yield output pulses according to the selected settings of the respective external resistance-capacitance timing networks R3*d*-C3*d* and R3*e*-C3*e*. The outputs from the two monostable multivibrators are 180° out of phase with one another and that their repitition period, 16.7 miliseconds, is the same as that of the power line. These outputs are connected to a conventional NAND-gate logic element NA3*a* which provides a train of positive-going output pulses, each of which occurs whenever one of the monostable outputs drops to zero and which lasts so long as the monostable output remains zero. According to the illustrated waveforms, these output pulses are 47 microseconds in duration. Because of the aforementioned manner of generation, these pulses occur every 8.3 miliseconds (i.e., one hundred twenty times each second) and are synchronized with the zero axis crossings of the power line. These are the clock pulses which are utilized throughout the circuitry that will hereinafter be described.

Figure 4:
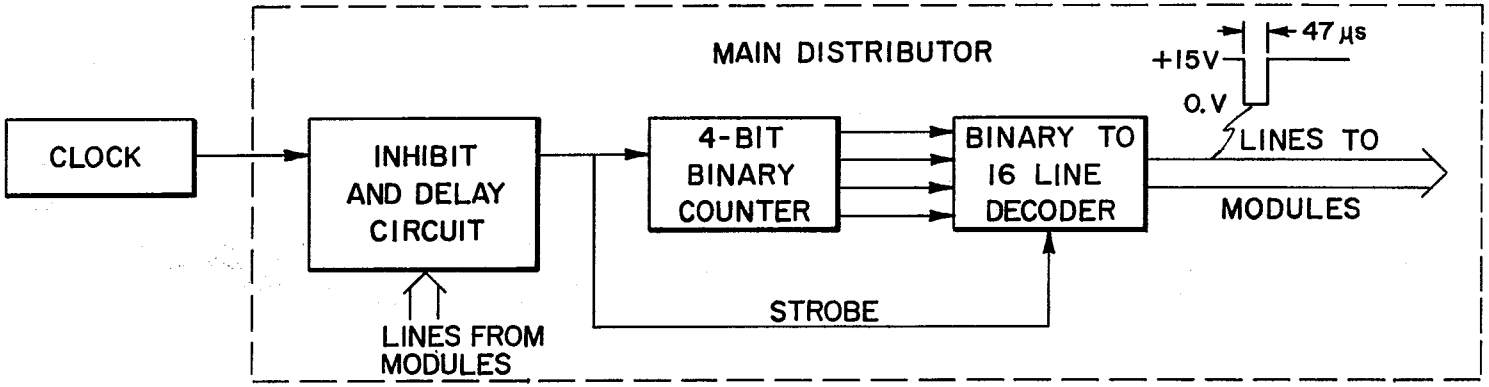
FIG. 4 is a schematic block diagram of a main distributor circuit for the system of the invention.

In FIG. 4, the previously-described clock is shown in general combination with other components that comprise what is hereinafter called the main distributor circuit. Generally speaking, this circuit sequentially operates to send a first pulse to the first module, then to send the next pulse to the second module and so forth. Each module is selected sequentially and to the exclusion of the others. In other words, this circuit functions analogously to a sixteen-position rotary switch insofar as it sequentially places a pulse on a first output line, then on a second and so forth, stepping from one line to the next for sixteen lines before returning to the first position.

According to FIG. 4, the clock pulses are fed to an inhibit-and-delay circuit and, assuming no solenoid rapper is energized anywhere in the precipitator at the time that a clock pulse reaches the inhibit circuit, the clock pulses pass through the inhibit and into a conventional four-bit binary counter. The inhibit circuit receives a signal anytime any rapper is operating in any of the modules; the generation of such signals will be explained in detail hereinafter. The inhibit circuit can be understood to operate basically as a multiple-input OR-gate coupled as an input together with the clock pulses to an AND-gate. The OR-gate will develop a blocking signal at the AND-gate anytime it receives a distinctive input from a module and will have a non-blocking output only if all the inputs are in the same state (i.e., if no impactors are activated at the time). The blocking signals can be conventionally stretched to provide a long time delay if desired. Various other well-known types of inhibit circuits can also be used here. One advantage of operating only one impactor at a time is that less capability is required from the (240 VAC) power supply; another advantage is the minimization of the possibility of precipitator puffing.

Each clock pulse that passes through the inhibit circuit increments the binary counter by a binary "1". The counter counts in a standard binary sequence: 0000, 0001, 0010, 0011, etc., for fifteen pulses before beginning again at 0000. The four bit positions in the counter each has a state of either 0 or 1 and there are sixteen different binary state combinations or codes. The four output lines from the counter are connected to a conventional binary-to-sixteen line decoder which functions to place a signal on one of its sixteen output lines depending upon the binary code received from the counter. In other words, each of the sixteen possible states of the four-bit counter is reflected as a signal on an individual output line from the decoder; for example, the binary code 0101 would be reflected as a voltage signal appearing only on the fifth output line. The decoder is strobed by the clock pulses so that it has outputs only during such times as it is in receipt of a clock pulse and, therefore, lasting only for the duration of the clock pulses; before a clock pulse arrives or after one passes, there can be no output signals on any of the lines from the decoder.

In normal operation, the decoder steps from one output line to the next sequentially as the four-bit counter is incremented. The decoder will not, however, step during such times as the inhibit circuit prevents the passage of clock pulses. Where there has been an interruption in the stepping sequence caused by the inhibit, the decoder will resume operation from its last position. In the absence of a delay imposed by the inhibit circuit, the stepping rate from module to module coincides with the clock period (8.33ms) and therefore stepping across sixteen modules requires a minimum 0.133 seconds.

The sixteen output lines from the decoder are each connected to a different one of the sixteen aforementioned control circuits for the individual modules. The control circuits independently determine the sequencing rate of rapper activation within the associated module and, also, control the intensity of the impacts delivered by the individual rappers. The sequencing rate refers to the minimun time period for the sequential activation of rappers in the module. For example, if module B were operated at a one minute sequencing rate, the fifth rapper in that module would not be operated until at least a minute had elapsed since operating the fourth rapper. The control circuits can each operate at a different sequencing rate and, in practice, the rates range from 0.5 seconds to 84.5 minutes depending upon the module location. Normally, the modules near the precipitator inlet operate at a faster sequencing rate than those towards the outlet. Even with the independent sequencing rates for each module, the control systems are coordinatively operated so that no more than one rapper can be energized at any one time in the precipitator.

Figure 6:
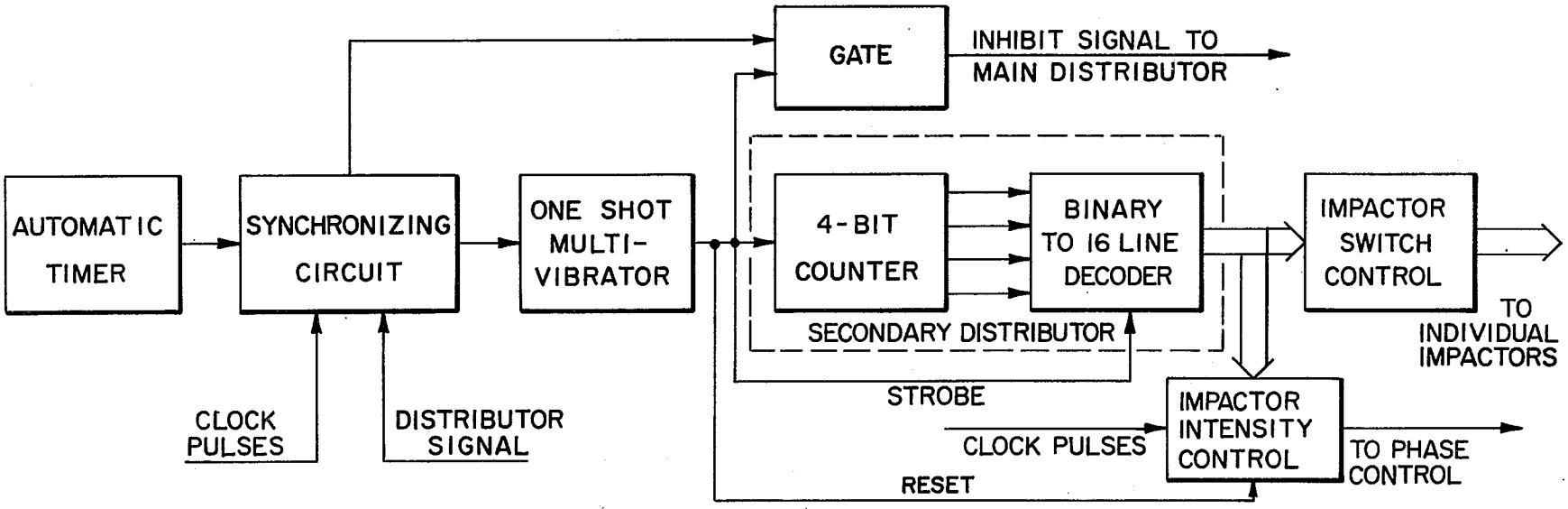
FIG. 6 is a block diagram of a control system for a single one of the rows of impacting devices shown in FIG. 2.

As shown in FIG. 6, a single one of the rapper-control circuits generally includes a conventional automatic timer that generates a continuous train of output pulses whose frequency determines the sequencing rate of the rappers in the associated module. The pulse train from the automatic timer is one of three inputs to a synchronizing circuit. The other two inputs are the clock pulses and the signals from the main distributor. The synchronizing circuit will provide an output signal only if all three inputs are simultaneously positive. A principal purpose of the synchronizing circuit is to coordinate matters so that the initiation of rapper energization (the so-called power interval) coincides in time with the leading edge of a clock pulse and, therefore, with the start of a power line cycle; such coordination allows close control of the intensity of the rapping action. Output signals from the synchronizing circuit trigger a conventional one-shot multivibrator to provide long-duration output pulses which are used to strobe the decoder and are sent through a delay gate to the inhibit circuit in the main distributor.

Each pulse from the one-shot multivibrator MV7*b* also increments a four-bit counter that is used in conjunction with a binary-to-sixteen line decoder to form a "secondary distributor" that functions similarly to the main distributor. The secondary distributor has sixteen output lines; a signal on any one of those lines is utilized for two functions. First, the signal will determine the output of an intensity control circuit which operates the alternating current phase-control circuit associated with the rectifier in FIG. 2. The phase control determines the amount of power which is allowed to pass through the rectifier to the module busses. Secondly, an output on a line from the decoder is applied to close the switch associated with a particular solenoid rapper within the module thereby permitting power to be applied to the coil of the rapper.

In practice, the aforementioned switches are all conventional silicon-controlled rectifiers (SCR's) but other types of switches, triacs for example, or relays, could be utilized. The SCR's are conventionally operated by driving their gates and the block labeled "impactor switch control" in the drawings can be understood to comprise the SCR gate driving circuits, each of which is activated by an associated line from the decoder. Thus, a signal appearing on one of the sixteen output lines from the secondary distributor will gate the associated SCR closed for the duration of the signal. The output lines from the switch control circuit are the control lines referred to with respect to FIG. 2.

Figure 7A:
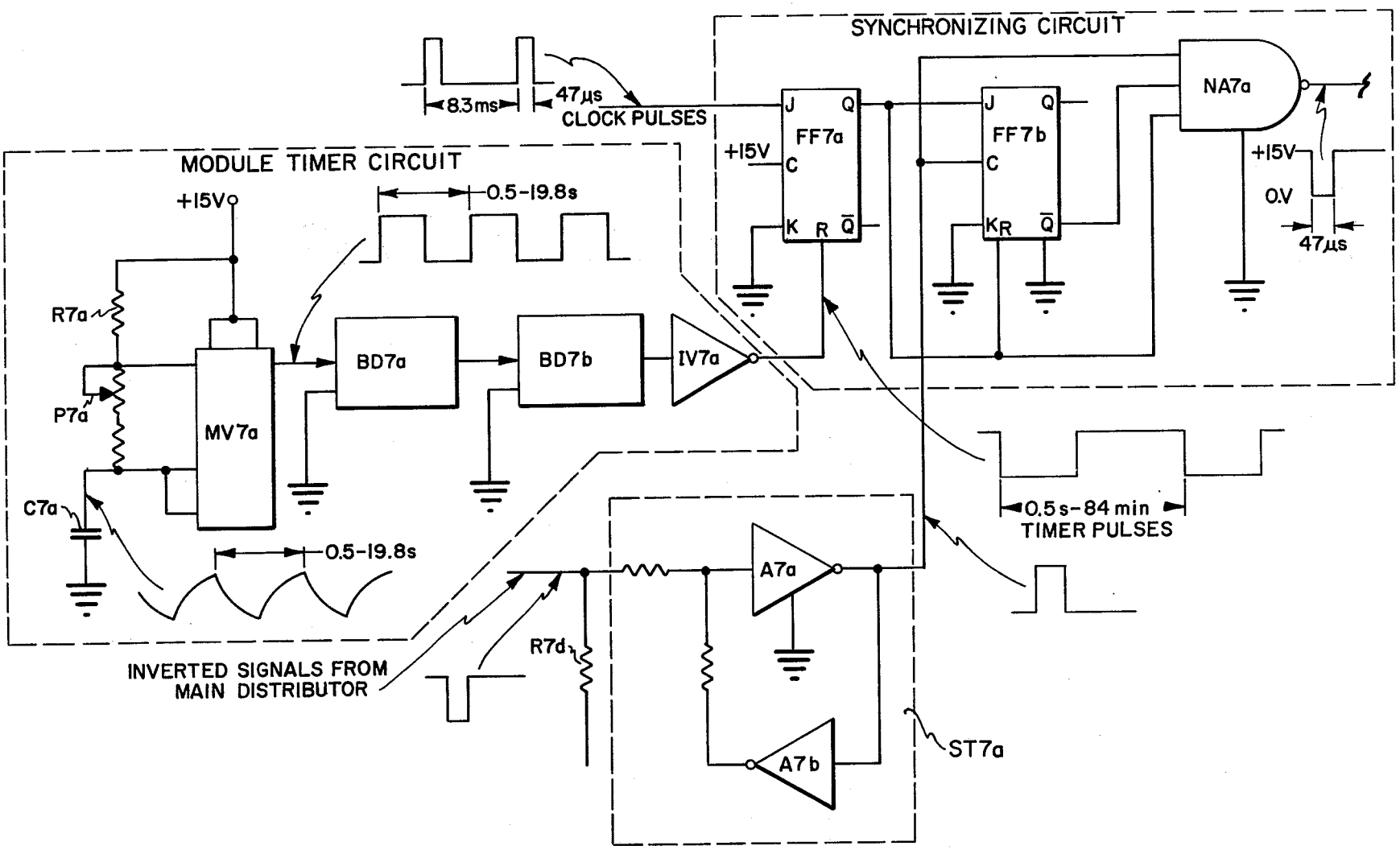
FIG. 7, comprising sheets *7a* and *7b*, is a schematic circuit diagram of the control system of FIG. 6.
Figure 7B:
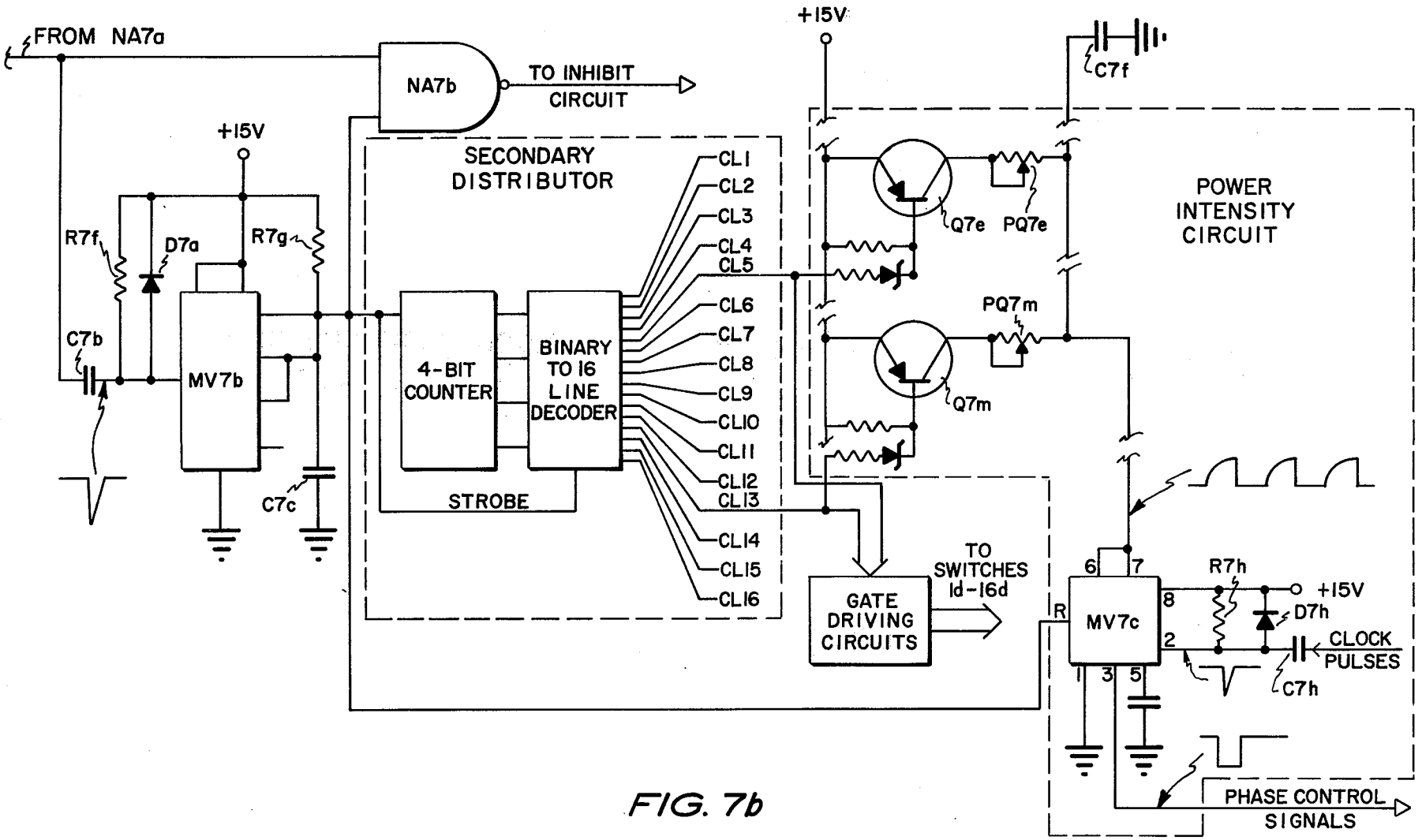

A representative one of the rapper-control circuits is shown in more detail in FIG. 7. Here again the waveforms at various points within the circuit are superimposed on the drawings. In this figure, the aforementioned timer comprises an astable multivibrator MV7*a* connected in a free-running mode to generate a continuous rectangular-wave pulse train. In practice, the multivibrator is a conventional 555-type timer. Associated with the multivibrator is a resistor R7*a*, a potentiometer P7*a* and a capacitor C7*a* which together adjustably determine the width and frequency of the output pulses. In practice, the potentiometer and capacitor provide adjustment of the output frequency from 0.5 seconds to 19.8 seconds. The output pulses from the multivibrator are fed to two conventional four-stage binary dividers BD7*a* and BD7*b* connected in series to provide division ratios of sixteen and two hundred fifty-six, respectively. The dividers are employed to yield slower frequencies than are normally or conveniently obtainable from the astable multivibrator MV7*a* alone; the output of the second divider, for example, can have a period exceeding eighty-four minutes. Depending upon which of the rapper modules is is being controlled and the desired sequencing rate, either or both of the dividers may be by passed in the circuit. The output pulses from the dividers are inverted by a conventional inverter IV7*a* and then are delivered to the synchronizing circuit.

The synchronizing circuit also receives signals on an associated one of the sixteen output lines from the main distributor circuit. Preferably, there is provided a network for shaping those distributor signals before passing them to the synchronizing circuit. In the illustrated arrangement, inverted output signals from the distributor are received by the shaping network and a resistor R7*d* is provided to bias or pull up the voltage on the distributor line to positive fifteen volts in the absence of an inverted distributor signal. Following the pull-up resistor R7*d*, there is a conventional Schmitt trigger circuit ST7*a*, comprising an associated pair of amplifiers A7*a* and A7*b*, which shapes or sharpens the distributor pulses and makes a re-inversion. These sharpened signals are then fed to the synchronizing circuit.

The synchronizing circuit illustrated in FIG. 7 includes a pair of conventional J-K flip-flops FF7*a* and FF7*b*, respectively, interconnected so that the "$\overline{Q}$" output of the first flip-flop serves as the "J" and "reset" inputs of the second flip-flop. The flip-flops function to synchronize the timer output with the clock pulses and the distributor pulses. In the illustrated flip-flop arrangement, clock pulses are received on the J-input of the first flip-flop FF7*a*, the distributor pulses are received on the clocking input of the second flip-flop FF7*b*, and the pulses generated by the astable multivibrator MV7*a* are received on the reset input of the first flip-flop FF7*a*. The K inputs of both flip-flops are tied to ground (logical "0"). The Q output of the first flip-flop FF7*a* and the Q output of the second flip-flop FF7*b* are two of the inputs to a three-input NAND-gate NA7*a*. The main distributor signals are the third input to that NAND-gate.

Figure 5:
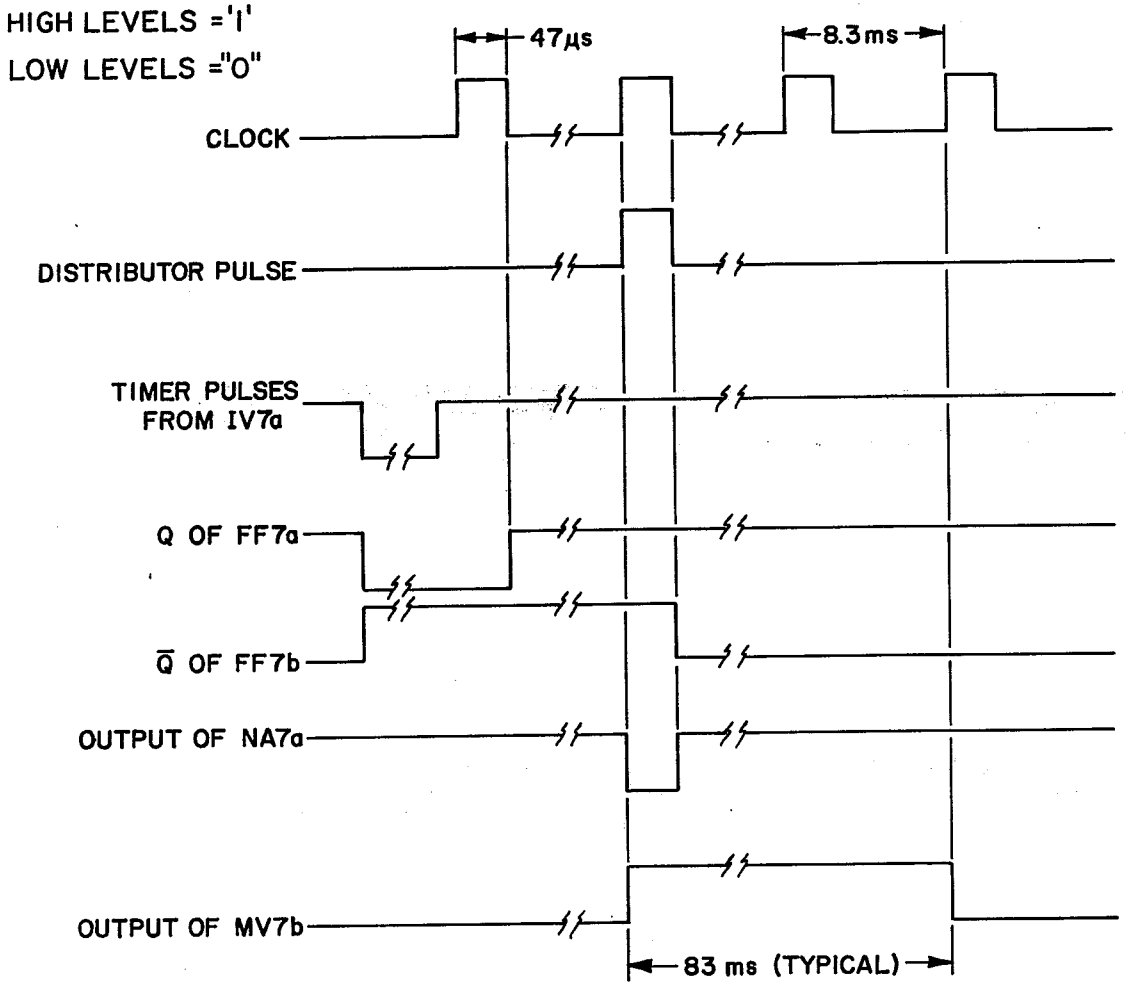
FIG. 5 is a diagram of signal waveforms at various locations within the system of the invention and shows the relationships between the signals with respect to time.

The operation of the illustrated flip-flop arrangement can be best understood by considering FIGS. 5 and 7 and a sequence beginning with the timer MV7*a* sending a logical 0 to the clear or reset terminal of the first flip-flop FF7*a*. That causes the Q output of that flip-flop FF7*a* to be reset at 0 independent of other inputs and that, in turn, resets the $\overline{Q}$ output of the second flip-flop FF7*b* to 1. Both flip-flops are held in the reset position until the timer goes high (i.e., to a logical 1). On the falling edge of the very next clock pulse occurring on the J input of the first flip-flop FF7*a* after the reset line goes high, the Q output of that flip-flop FF7*a* will go to a logical 1 and, accordingly, the second flip-flop FF7*b* will no longer be held in the reset position and, also, it will have a 1 on its J input. At that time, two of the inputs to the NAND-gate NA7*a* are logical 1's (i.e., the Q input from FF7*a* and the $\overline{Q}$ input from FF7*b*) but the third input (the distributor line) is still zero. (The Q output of the first flip-flop FF7*a* will remain high until the flip-flop is reset by a pulse from the timer MV7*a* which, it should be remembered, has a relatively low frequency; in other words, several distributor or clock pulses will arrive at the NAND-gate NA7*a* well before another timer pulse is generated.) The next distributor pulse which occurs will coincide in time with a clock pulse (because the clock pulses strobe the main distributor) and there will then be logical 1's on all three inputs to the NAND-gate NA7*a*. In response to the coincidence condition, the NAND-gate NA7*a* will "trigger" to yield a negative-going output which will last for the duration of the clock pulse.

On the falling edge of the triggering distributor pulse, the $\overline{Q}$ output of the second flip-flop FF7*b* will go to zero. That occurs because the distributor line is connected to the clocking input of that flip-flop and because a transition of the output of a flip-flop occurs, due to the nature of a flip-flop, only when an input makes a 1 to 0 transition. After the $\overline{Q}$ output of the flip-flop FF7*b* goes low, the NAND-gate NA7*a* cannot be triggered regardless of the state of its other two inputs. Furthermore, the $\overline{Q}$ output of the second flip-flop FF7*b* will remain low until such time as the flip-flops are reset by a pulse from the timer MV7*a*. In other words, there can be no coincidence of positive signals at the NAND-gate NA7*a* at least until after the next timer pulse has been generated by the multivibrator MV7*a*.

It should be noted that coincidence of three positive inputs to the NAND-gate NA7*a* can occur only if a timer pulse and then a clock pulse was received by the first flip-flop, in that sequence. In other words, the synchronizing circuit operates in a manner analogous to firing a gun. After a timer pulse cocks (resets) the synchronizing circuit, the next clock pulse (maximum of 8.33ms later) removes the safety (sets the first flip-flop) and then the next entering distributor pulse pulls the trigger (i.e., all three inputs to the NAND-gate NA7*a* are positive in coincidence). As will be described in the following, such coincidence is used to develop a signal to inhibit the main distributor from stepping to the next module for a short delay period. After the delay, the main distributor sends a signal to the next module in sequence and tries to pull the trigger there. If the timer for that module has cocked the gun and the clock has removed the safety, then a rapper will be operated in that module also. But if the module is not ready, the distributor will step successively and in sequence from module to module until one is found that is ready for triggering. If the illustrated synchronizing circuit is cocked by the receipt of a pulse from timer MV7*a* during the time a rapper is operating in another module (i.e., during a time when the main distributor is inhibited), the cocking signal is, in effect, stored or remembered by the synchronizing circuit until the main distributor actually sends a signal to the synchronizing circuit.

Outputs from the previously-mentioned NAND-gate NA7*a* in the synchronizing circuit are used to actuate a one-shot multivibrator MV7*b* whose output, in turn, is used to trigger the inhibit circuit in the main distributor, to strobe a "power intensity" circuit which determines the energy directed to a rapper in the module and to activate a "secondary distributor" circuit which determines which rapper in the module will receive such power. An output pulse from the one-shot MV7*b* can be understood to define a time window or interval, usually about 83.3 miliseconds, in which the latter three circuits operate. A positive-going relatively long-duration output pulse from the one-shot MV7*b* occurs only when the NAND-gate NA7*a* has fired and, it should be noted, the pulses start on a zero-axis crossing of the power line waveform.

As previously mentioned, the pulses from the one-shot MV7*b* are delayed slightly before being sent to the inhibit circuit. The delay is provided to avoid truncation of the main distributor signals. In the illustrated circuit, the delay is provided by a NAND-gate NA7*b* which receives pulses from the NAND-gate NA7*a* in addition to signals from the one-shot MV7*b;* the initial portions of the positive-going one-shot signals are blocked from passing through the gate NA7*b* for the duration of the negative-going output pulses from the gates NA7*a*.

With the circuitry shown in FIG. 7, the output of the NAND-gate NA7*a* is first differentiated to form a narrow negative-going pulse having a spike-like appearance, which pulse is then applied to trigger the one-shot MV7*b*. Differentiation is accomplished here by a network comprising a capacitor C7*b*, a resistor F7*f* and a diode D7*a*. The one-shot MV7*b* is preferably a 555-type timer and includes a resistor R7*g* and a capacitor C7*c* which bypass an internal voltage divider.

The secondary distributor circuit in FIG. 7 operates to select and close the switch associated with a particular one of the solenoid rappers in the associated module. The circuit employs a conventional four-bit binary counter and a binary-to-sixteen line decoder with a strobe from the one-shot MV7*b*. The counter has sixteen different binary states and four output lines which connect to the decoder. The counter is incremented each time after receiving an output from the one-shot MV7*b* and each of the sixteen possible binary states is reflected as a signal on an individual output line from the decoder. The distributor steps from one output line to the next in sequence. Because of the strobe, the decoder outputs appear only in the time windows defined by the pulses from the one-shot MV7*b*.

Output pulses on the lines from the decoder in FIG. 7 are utilized for two functions. First, the outputs are used to close individual ones of the switches associated with particular solenoid rappers within the module. Thus, for example, the fifth line from the decoder is associated with the switch for the fifth rapper in the module and the thirteenth line with the switch for the thirteenth rapper. Although various types of switches can be used, SCR's are preferred and, therefore, individual gate-driving circuits must be provided. In FIG. 7, the gate-driving circuits are shown in a single block, but in practice those circuits are independent and each is separately actuated by a signal on an associated one of the decoder lines. Various well-known SCR gating circuits can be used here.

Output signals from the decoder in FIG. 7 are also used in the aforementioned intensity control circuit. Each of the decoder output lines is connected to the base of an associated conventional PNP-type transistor; for example, the fifth output line from the decoder connects to the base of a transistor Q7*e* and the thirteenth output line connects to the base of a thirteenth transistor Q7*m*. The transistors are arranged in a repetitive array such that their emitters all connect to a common voltage source (+15V) and their collectors connect to individual adjustable potentiometers (e.g., PQ7*e* and PQ7*m*). All of the potentiometers are tied to a capacitor C7*f* common to the control system. A transistor in the array conducts current from the source whenever a negative voltage pulse is applied to its base; in other words, each transistor acts as a switch and the switching pulses are the output signals from the decoder. Since the output lines from the decoder are activated sequentially, the transistors in the array conduct in sequence. Current conducted by any one of the resistors charges the common capacitor C7*f* and the transient voltage across the capacitor is utilized as a timing signal to a one-shot multivibrator MV7*c* which is illustrated as a conventional 555-type timer. The duration of an output pulse generated by the one-shot MV7*c* is determined by the settings of the independently adjustable potentiometer associated with the conducting transistor. These output pulses from the one-shot MV7*c* are the aforementioned phase control signals.

Triggering signals to the one-shot MV7*c* are derived from inverted clock pulses so that the start of any output from MV7*c* will coincide with a zero-axis crossing of the power line waveform. In the illustrated arrangement, the clock pulses are first differentiated to form narrow negative-going spike-like signals by means of a network comprising a capacitor C7*h*, a resistor R7*h*, and a diode D7*h*. Strobing of the one-shot MV7*c* is determined by positive-going signals from the preceding one-shot multivibrator MV7*b*. The phase control signal from one-shot MV7*c* can occur only during the power interval defined by the one-shot multivibrator MV7*b*. Since the potentiometers in an intensity control circuit can be individually set, the duration of each and every pulse from the intensity control circuit can be individually determined. And since each pulse train from the intensity control circuit is associated with a particular solenoid rapper in the module, the system provides individual control of the intensity of the impact delivered by each of every one of the rappers.

The output pulses from the one-shot MV7*c* are applied to the phase-control circuit associated with the rectifier which was mentioned in conjunction with FIG. 2. The duration of the timer pulses determines the conduction angle and duration of the power supplied to the rectifier and, therefore, determines the intensity of the direct-current energy output from the rectifier. Various well-known phase control circuits can be utilized here; typically, such circuits comprise power-SCR's connected anti-parallel. In practice, the phase control is from about 30° to 150° and, essentially, allows an intensity range from zero to full intensity. The phase-control circuit receives signals from the rapper-control circuits for all the modules; to accomodate the multiplicity of inputs an OR-gate can be used at the input to the phase-control circuit since only one rapper operates in the precipitator at any given time.

The system which has been described hereinbefore for operating the impacting devices can, with some modifications, be utilized to control the emitter wire vibrators as well. In practice, there is usually only a single module of vibrators and, accordingly, the secondary distributor circuits are eliminated as are the synchronizing circuits. It is also preferable in a vibrator control system to use triacs as switches, rather than SCR's, since the former have an inherent intensity control action. In the following claims, the term "shaker" or "shaking" should be understood to encompass either rappers or vibrators, and the action thereof.

I claim:

1. In an electrostatic precipitator having electrically-activated rappers arranged in a plurality of modules that operably extend transverse to the gas flow direction through the electro-static precipitator, each of said modules comprising a plurality of rappers connected in parallel across associated busses, and each of said rappers having an electrically-operated normally-open switch connected thereto to control the flow of electricity to the rapper from the associated buss; and each of said rappers being connected to shake an electrode of the precipitator to dislodge particulates therefrom, a system for operating the rappers the improvement comprising:

a. a main distributor circuit including a plurality of output lines, said main distributor circuit operating to place an electrical signal on each one of said output lines in sequence and to the exclusion of the other said output lines at a first predetermined rate;

b. a plurality of control circuits, each said control circuit associated with a particular one of said modules and each said control circuit including:

i. a timer means for generating a continuous train of signals at an adjustable second rate that is substantially slower than said first predetermined rate;

ii. synchronizing means connected to a particular one of said output lines of said main distributor circuit to receive signals therefrom and, also, connected to receive said train of signals from said timer means, said synchronizing means being operative to generate an output signal only if it receives a signal from said timer means followed by a signal from said main distributor circuit; and iii. a secondary distributor circuit that is connected to receive said output signals from said synchronizing means and which includes a plurality of output lines, each of said secondary distributor output lines being connected to a said switch of a particular one of said rappers in the associated module, said secondary distributor circuit being operative to place an electrical output signal on each of its said output lines in an ordered sequence and to the exclusion of the other of its said output lines, each sequential placement being made upon the receipt of an output signal from said synchronizing means, and said electrical output signals from said secondary distributor circuit being operative to close the switch of the rapper which receives the signal to activate that rapper with power from said associated buss.

2. A system according to claim 1 further including an inhibit means which is connected between all the synchronizing means in said plurality of control circuits and said main distributor circuit and which is operative to interrupt the sequential operation of said main distributor circuit for a short time whenever a said output signal is received from any one of said synchronizing means.

3. A system according to claim 1 further including a plurality of intensity control means each of which is connected to one of said rappers to independently control the rapping energy thereof.

4. A system according to claim 1 wherein the output frequency of each of said timer means is independently adjustable.

5. A system according to claim 1 including power supply means for energizing all of said busses with line power.

6. A system according to claim 5 further including:

a. a phase-control means connected to control the conduction angle of the line power to said power supply means; and b. a plurality of independently-adjustable signal-lengthening means, each connected to a particular output line from a secondary distributor circuit and operable to provide a control signal of adjustable duration to control said phase-control means.

7. A system according to claim 5 further including a main clock means which generates a continuous series of pulses which are periodic with respect to zero-axis crossings of the line power; the output of said main clock means being connected to all of said synchronizing means so that the initiation of the output signals generated thereby coincide with the clock pulses.

8. A system according to claim 7 wherein said main distributor circuit includes a clock means to generate a continuous series of pulses, a binary counter means connected to count the pulses from said clock, and a binary decoder to place an electrical signal on said distributor output lines according to the count of said counter.

9. A system according to claim 8 including a strobe means actuated by said clock pulses to strobe said decoder.

10. A system according to claim 8 wherein said clock means generates pulses that are periodic with respect to zero-axis crossings of the line power and said clock means is connected to each of said synchronizing means so that the initiation of the output signals generated thereby coincide with said clock pulses.

11. A system according to claim 7 wherein said clock means operates such that the leading edges of the pulses generated thereby coincide in time with the zero-axis crossings of the line power and said synchronizing means operates so that initiation of the output signals generated thereby coincide with the leading edges of said clock pulses.

12. A system according to claim 11 further including digital counting means connected to receive and count the clock pulses and to control the sequential operation of said main distributor circuit according to the count.

* * * * *